United States Patent [19]

Woodward

[11] Patent Number: 4,564,958

[45] Date of Patent: Jan. 21, 1986

[54] NECKTIE

[76] Inventor: Robert F. Woodward, 1642 Avon Pl., NW., Washington, D.C. 20007

[21] Appl. No.: 478,082

[22] Filed: Mar. 23, 1983

[51] Int. Cl.[4] ..... A41D 25/02

[52] U.S. Cl. ..... 2/150; 2/146

[58] Field of Search ..... 2/150, 146, 144, 156

[56] References Cited

U.S. PATENT DOCUMENTS

| | | | |
|---|---|---|---|
| 2,148,154 | 2/1939 | Garfinkle | 2/146 |
| 2,499,260 | 2/1950 | Rhein | 2/146 |
| 2,679,050 | 5/1954 | Dzus | 2/146 |
| 2,739,313 | 3/1956 | Burton | 2/146 |
| 3,271,780 | 9/1966 | De Jean | 2/146 |
| 3,335,426 | 8/1967 | Light | 2/146 |
| 3,490,073 | 1/1970 | Webster | 2/146 |
| 3,797,044 | 3/1974 | Chow | 2/146 |

*Primary Examiner*—Werner H. Schroeder
*Assistant Examiner*—J. L. K. Olds
*Attorney, Agent, or Firm*—Cushman, Darby & Cushman

[57] ABSTRACT

A four-in-hand necktie is provided on its reverse side with a tactile indicator located at a standard distance, preferably about 12 inches, from the midlength toward the extremity of the end which underlies the other end when the necktie is tied, such indicator being adapted to be aligned substantially flush with the collar button of a collared garment when the necktie is draped over the neckband thereof to assure that the ends of the necktie will be substantially even when the necktie is tied.

1 Claim, 3 Drawing Figures

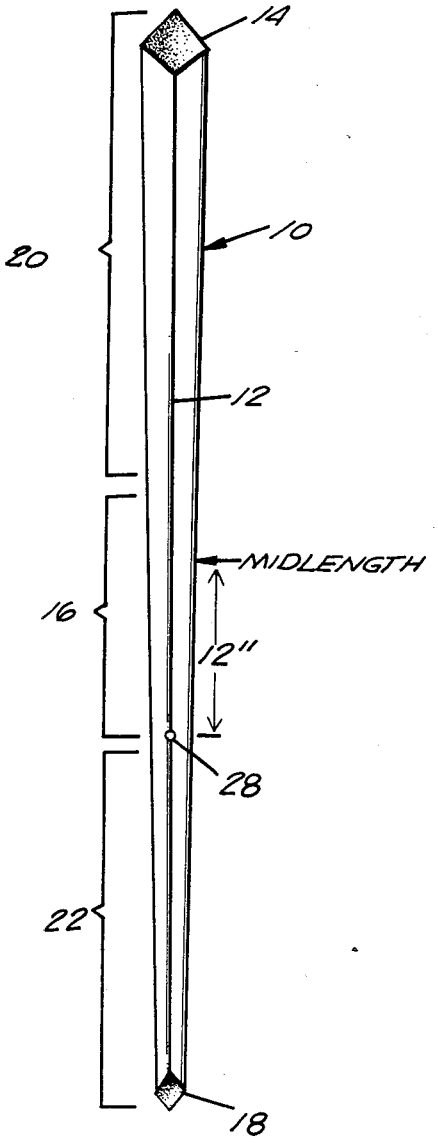
Fig. 1
Fig. 2
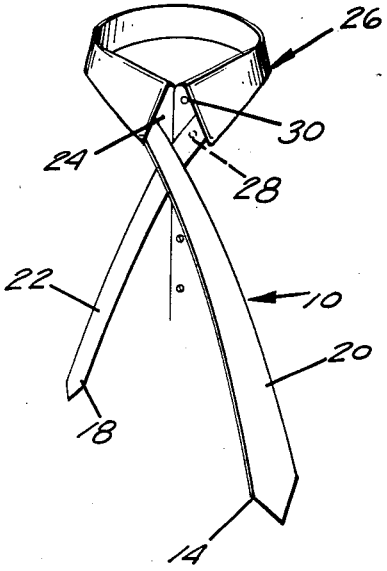
Fig. 3
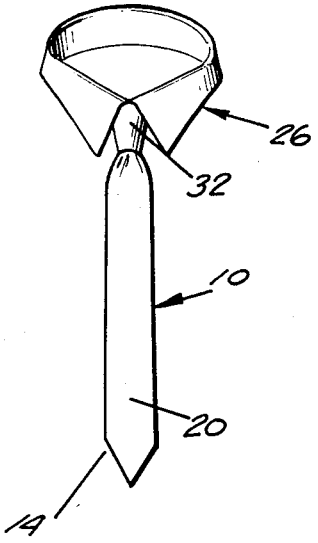

NECKTIE

FIELD OF THE INVENTION

This invention relates to neckties and, more particularly, to facilitating the correct placing of a four-in-hand necktie on the neckband of the shirt, or comparable collared garment, of a wearer to assure that the necktie will be tied neatly. In other words, to assure that, when tied, the ends will be of substantially the same length, i.e., even; more especially, to assure that the overlying end, usually wider than the underlying end, is not shorter than, the same length as, or slightly longer than the underlying end.

BACKGROUND OF THE INVENTION

A necktie of the four-in-hand type usually, but not necessarily, flares or gradually widens from the central neckband portion toward the extremities, with one end usually being wider than the other. When looped or draped about the neckband of the garment of the wearer, the wide end is tied in a slip knot about the narrow end, with the two ends depending and overlapping vertically in front.

For correct sartorial appearance, a four-in-hand necktie should be tied neatly. By neatly it is meant that, when tied, not only is the knot neat, but also the overlying end is not shorter than the other end and, at the most, is not much longer than the other or underlying end. Nothing so evidences sartorial disarray and general untidiness than an unneatly tied four-in-hand necktie having either end, especially the underlying end, hanging down much below the other end.

The tying of a four-in-hand necktie neatly requires experience and skill. Desirably, both ends of a tied four-in-hand necktie are of the same length, but this requires much skill. Even so, a neatly tied necktie frequently is attained only after several trial and error attempts. If the underlying end is too long, the knot must be untied, adjustments made, and the knot retied. If the underlying end is too short, the knot need only to be loosened, adjustments made, and the knot retightened. All this, however, leads to wastage of time, unnecessary expenditure of energy, annoyance and even exasperation with wear and tear on the nerves, let alone on the necktie.

The problem of neatly tying a four-in-hand necktie on the first try has been recognized and proposals made to solve it. Exemplary of such proposals are the disclosures of the following patents:

U.S. Pat. No. 2,499,260, Rhein, Feb. 28, 1950
U.S. Pat. No. 2,994,886, Sharp, Aug. 8, 1961
U.S. Pat. No. 3,025,528, Minter, Mar. 20, 1962
U.S. Pat. No. 3,271,780, DeJean, Sept. 13, 1966
France No. 967,537, Billioque, Mar. 29, 1950

None of the foregoing patent disclosures, however, really solve the problem efficiently, or as efficiently and simply and with as little expense and as much ease of manipulation and convenience for the user as the invention for which this patent application is made. Of the above-listed patents, the disclosure of U.S. Pat. No. 2,499,260 purportedly offers an optimum solution by providing spaced physically detectable indicators on the underside of a tie to be arranged equidistant from the front opening of a neckband, when tie is draped thereon, the theoretically assure that the tie is tied neatly. Aside from necessitating more than one indicator, however, the disclosure of this patent does not make it clear exactly where the indicators are to be located on the necktie, i.e. the longitudinal location. The other U.S. patents would seem to offer solutions less desirable than that proposed by U.S. Pat. No. 2,499,260.

The solutions proposed by above-listed French patent also purport to be of an optimum nature. The solutions proposed, however, in the main require the provision of a series of indicators on either the underlying or the overlying end of the necktie, with the necktie adjusted on the neck of the wearer preliminary to tying the knot so that one indicator, depending on neck size, is adjacent an overlapping portion of the other end to assure even ends when the necktie is tied. Again, however, a plurality of such indicators is needed.

BRIEF SUMMARY OF THE INVENTION

Accordingly, it is an object of this invention to provide a four-in-hand necktie with a single simple, inexpensive, easily used, tactile indicator that is completely concealed from view when the necktie is tied, and which when properly used will assure that the necktie will be tied neatly.

It is another object of this invention to provide a necktie with an indicator of the foregoing type that can be affixed easily and inexpensively by the manufacturer of the necktie and that will be usable by wearers of different neck sizes.

The foregoing objects are attained by providing a tactile indicator on the under, reverse or back side of the underlying narrow end of the necktie at a standard distance, preferably about 12" from the longitudinal mid-length of the necktie. When the necktie is draped on the neck, or rather on the neckband of a collared garment of the wearer, the necktie is adjusted so that the indicator is aligned flush with the collar button of the garment or at the small standard variance from this flush position which the individual wearer finds desirable for his own use. For average size necks, i.e. of collar sizes 15-½-16, such flush alignment will assure a neatly tied necktie. For a collar of other sizes, the correct spacing of the indicator beyond or short of the collar button is ascertained easily, by simple trial and error, and amounts to only a short distance, e.g. a matter of an inch or a fraction thereof.

Other objects and advantages of the invention will be apparent from the following detailed description and accompanying drawings.

BRIEF DESCRIPTION OF THE DRAWINGS

FIG. 1 is a view of the under or back side of a conventional four-in-hand necktie laid out straight and flat showing the position of an indicator in accordance with this invention.

FIG. 2 is a fragmentary perspective view of the necktie shown in FIG. 1 draped about the collar band of a garment and correctly adjusted to assure even ends when collared the necktie is tied.

FIG. 3 is a perspective view of the tied necktie shown in FIG. 2 illustrating the even ends.

DETAILED DESCRIPTION OF THE INVENTION

Referring now to the drawings, there is shown a conventional four-in-hand necktie 10 in the form of a flat band of fabric folded with its edges seamed together, as at 12, on its back or reverse side and which flares or widens gradually toward one extremity 14 from a central neckband portion 16. The necktie 10 also may flare or widen gradually from the neckband portion 16 toward the other extremity 18 which usually is much narrower than the wide extremity 14. When tied, the depending vertically overlapping portions or lengths of the necktie usually are called "ends" with the wide end 20 overlying the narrow end 22. The narrow end may not flare, however, and be of generally the same width throughout. Further, both ends may not flare at all and each, and even both, be of substantially the same width throughout.

In order to assure that the necktie 10 will be positioned or draped properly on the neckband 24 of a collared garment 26, as shown in FIG. 2, to assure a neatly tied necktie, I provide a tactile indicator 28 on the reverse or back side of the narrow or underlying end 22 about 12 inches from the midlength of the necktie, and preferably at about its midwidth, i.e. equidistant from either side of the necktie. The indicator 28 may be of any form and material which can be readily felt on the reverse surface of the necktie when the necktie is grasped normally between the thumb and finger or fingers of the wearer for adjusting the ends 20, 22 preparatory to tying the slip knot. Preferably, the indicator 28 is small to avoid possible interference with tying the slip knot and to avoid the possibility of becoming visible when the necktie is being worn. The indicator 28 may be a tactile tab of any suitable material, e.g. cloth, plastic, etc. attached by any suitable means, e.g. sewing, glue, etc. to the necktie. It also may be formed by a stitch or several stitches of any suitable thread. It is sufficient for its intended purpose that the indicator 28 be correctly located and readily felt when the necktie is grasped by a wearer at the location of the indicator.

When so grasped, in order to correctly adjust the necktie 10 to assure a neatly tied necktie, the wearer adjusts the necktie longitudinally or lengthwise about the collarband 24 so that the indicator is aligned substantially flush with the collar button 30 of the collar 26, which usually is buttoned up at this point in the process. The wearer then may proceed to tie the conventional slip knot 32 by overlapping the wide of overlying end 20 over the narrow or underlying end 22, pushing the wide end up and around the underlapping portion of the narrow end and down between the overlapping and underlapping portions. When the slip knot 32 is tied and tightened, the two ends 20, 22 will be substantially even, as shown in FIG. 3 when the neckband 24 is of average size, i.e. 15-½-16.

If the neckband 24 is of a lesser or greater size than average, the wearer can, by a one-time trial and error process, determine the correct spacing of the indicator 28 from the collar buttom 30 to accommodate variations from average neck or collar size. For example, if the neckband is size 14-½, the indicator 28 will be located a short distance, e.g. a fraction of an inch, beyond the collar button 30. If the neckband is size 17, the indicator 28 will be located a short distance, e.g. a fraction of an inch short of the collar button 30. Those distances will be readily ascertained and remembered by the necktie owner for properly adjusting the draped necktie thereafter.

It thus will be seen that the objects and advantages of this invention have been fully and effectively achieved. It will be realized, however, that the foregoing specific embodiment has been disclosed only for the purpose of illustrating the principles of this invention and is susceptible of modification without departing from such principles. Accordingly, the invention includes all embodiments encompassed within the spirit and scope of the following claim.

I claim:

1. A four-in-hand necktie permanently provided on its backside with a single tactile indicator located at a predetermined standard distance of about 12 inches from the midlength of the necktie toward the extremity of the end which underlies the other end when the necktie is tied, such indicator being adapted to be located in substantially flush alignment with the collar button of a collared garment when said necktie is draped over the neckband thereof to assure that said ends will be substantially even when the necktie is tied, whereby such indicators can be applied by a manufacturer to a series of neckties and be effective in use with all such ties.

* * * * *